US007772171B2

(12) United States Patent
Al-Ahmad et al.

(10) Patent No.: US 7,772,171 B2
(45) Date of Patent: Aug. 10, 2010

(54) METHOD OF LUBRICATING AN INTERNAL COMBUSTION ENGINE AND IMPROVING THE EFFICIENCY OF THE EMISSIONS CONTROL SYSTEM OF THE ENGINE

(75) Inventors: Saleem Al-Ahmad, Euclid, OH (US); Melody Wilk, Timberlake, OH (US); Jack Kelley, Chagrin Falls, OH (US); John K. Pudelski, Cleveland Heights, OH (US); Paul E. Adams, Kirtland, OH (US); Ewa Bardasz, Mentor, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 991 days.

(21) Appl. No.: 11/457,863

(22) Filed: Jul. 17, 2006

(65) Prior Publication Data

US 2008/0015129 A1 Jan. 17, 2008

(51) Int. Cl.
*C10M 137/06* (2006.01)
*C10M 133/56* (2006.01)

(52) U.S. Cl. ..... 508/371; 508/368; 508/376; 508/291

(58) Field of Classification Search ..... 508/368, 508/371, 376, 291
See application file for complete search history.

(56) References Cited

U.S. PATENT DOCUMENTS

| | | | | |
|---|---|---|---|---|
| 4,101,428 | A * | 7/1978 | Crawford | 508/371 |
| 4,904,401 | A | 2/1990 | Ripple et al. | |
| 5,919,740 | A | 7/1999 | Bloch | |
| 2002/0006878 | A1 * | 1/2002 | Abraham et al. | 508/186 |
| 2005/0166868 | A1 | 8/2005 | Wilk et al. | |

FOREIGN PATENT DOCUMENTS

| | | | |
|---|---|---|---|
| EP | 0787789 | A2 | 8/1997 |
| EP | 1167497 | | 1/2002 |
| EP | 1203806 | | 5/2002 |
| WO | 03/104620 | A2 | 12/2003 |
| WO | WO 03104620 | A2 * | 12/2003 |

OTHER PUBLICATIONS

Search Report of corresponding international application PCT/US2007/073428, date of mailing: Mar. 6, 2008.
Written Opinion of corresponding international application PCT/US2007/073428, date of mailing: Mar. 6, 2008.
"Balancing Crankcase Lubricant Performance with Catalyst Life," Chamberlin et al., SAE Technical Paper Series 841407, Oct. 8-11, 1984.
"Development and Significance of the Phosphorius Emission Index of Engine Oils," Selby, 13th International Colloquium Tribology—Lubricants, Materials and Lubrication Technischa Akademie Esslingen, Stuttgart, Germany, Jan. 15-17, 2002 (accessed at http://www.savantgroup.com/PhosIndex-v2.pdf, site updated Jan. 2003).

* cited by examiner

*Primary Examiner*—Glenn Caldarola
*Assistant Examiner*—Jim Goloboy
(74) *Attorney, Agent, or Firm*—David M. Shold; Christopher D. Hilker

(57) ABSTRACT

An internal combustion engine with a catalyst-containing exhaust-gas aftertreatment device is lubricated with a composition of a base oil; and a zinc salt of a mixture of phosphorus-containing compounds having hydrocarbyl groups $R^1$ and $R^2$ where the average total number of carbon atoms in $R^1$ plus $R^2$ for the mixture of phosphorus-containing compounds is at least 9.5, where 4 to 30 weight percent of such groups contain 2 to 4 carbon atoms and where in less than 8 mole percent of the phosphorus-containing molecules in the mixture of phosphorus-containing compounds each of $R^1$ and $R^2$ contain 2 to 4 carbon atoms.

22 Claims, No Drawings

METHOD OF LUBRICATING AN INTERNAL COMBUSTION ENGINE AND IMPROVING THE EFFICIENCY OF THE EMISSIONS CONTROL SYSTEM OF THE ENGINE

TECHNICAL FIELD

This invention relates to a method of lubricating an internal combustion engine and improving the efficiency of the emissions control system of the engine.

BACKGROUND OF THE INVENTION

For decades phosphorus in the form of zinc dihydrocarbyldithiophosphates (ZDDPs) has been used as extreme pressure (EP) and antiwear additives in engine oils. A problem with the use of phosphorus, however, is that it may contaminate emissions control systems catalysts and thereby reduce their effectiveness. In response to this problem, phosphorus concentration has been reduced for some SAE passenger car engine oil classifications. With the introduction of ILSAC GF-1, phosphorus levels were limited to no more than 1200 parts per million (ppm) and with GF-3 to 1000 ppm. Even at these levels of phosphorus, however, catalyst contamination is still an issue.

Various attempts have been made to reduce the phosphorus content of exhaust by reducing the contribution thereto from phosphorus in the engine lubricant. In one approach, published application US 2005/0166868 describes a method of lubricating an internal combustion engine by selecting a lubricating oil composition including a metal salt of one or more phosphorus-containing compounds represented by the formula

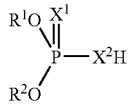

wherein the average total number of carbon atoms in hydrocarbyl groups $R^1$ and $R^2$ for the one or more phosphorus-containing compounds is at least 10.4. Although such approaches have provided a measure of success, the problem remains to provide adequate engine lubrication and at the same time further reduce phosphorus contribution to the exhaust and the corresponding risk for catalyst contamination. The present invention provides a solution to this problem.

SUMMARY OF THE INVENTION

This invention relates to a composition, as well as a method of lubricating an internal combustion engine equipped with a catalyst-containing exhaust-gas aftertreatment device with the composition, the method comprising supplying to said engine a lubricating oil composition comprising: (a) a base oil; and (b) a zinc salt of a mixture of phosphorus-containing compounds represented by the formula:

(I)

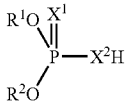

wherein in formula (I), $X^1$ and $X^2$ are independently S or O, and $R^1$ and $R^2$ are independently hydrocarbyl groups, the average total number of carbon atoms in $R^1$ plus $R^2$ for the mixture of phosphorus-containing compounds being at least 9.5; wherein $R^1$ and $R^2$ are characterized in that (i) 4 to 70 weight percent of such groups contain 2 to 4 carbon atoms and (ii) 30 to 96 weight percent such groups contain 5 to 12 carbon atoms; and wherein, in less than 8 mole percent of the molecules of formula (I) in the mixture of phosphorus-containing compounds, each of $R^1$ and $R^2$ contain 2 to 4 carbon atoms and in greater than 11 mole percent of the molecules of formula (I) in said mixture $R^1$ has 2 to 4 carbon atoms and $R^2$ has 5 to 12 carbon atoms; and wherein, within formula (I), the average total number of hydrogen atoms in $R^1$ and $R^2$ on carbon atoms located beta to the O atoms is at least 7.25; the lubricating oil composition being characterized by a phosphorus concentration of up to 0.12 percent by weight.

DETAILED DESCRIPTION OF THE INVENTION

The term "hydrocarbyl," when referring to groups attached to the remainder of a molecule, refers to groups having a purely hydrocarbon or predominantly hydro-carbon character within the context of this invention. Such groups include the following:

(A) purely hydrocarbon groups; that is, aliphatic, alicyclic, aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Examples include methyl, octyl, cyclohexyl, phenyl, etc.

(B) substituted hydrocarbon groups; that is, groups containing non-hydrocarbon substituents which do not alter the predominantly hydrocarbon character of the group. Examples include hydroxy, nitro, cyano, alkoxy, acyl, etc.

(C) hetero groups; that is, groups which, while predominantly hydrocarbon in character, contain atoms other than carbon in a chain or ring otherwise composed of carbon atoms. Examples include nitrogen, oxygen and sulfur.

In general, no more than about three substituents or hetero atoms, and in one embodiment no more than one, will be present for each 10 carbon atoms in the hydrocarbyl group. In certain embodiments, hydrocarbyl groups are non-aromatic hydrocarbon groups or saturated hydrocarbon groups.

The term "oil-soluble" refers to a material that is soluble in mineral oil to the extent of at least about 0.5 gram per liter at 25° C.

The term "TBN" refers to total base number. This is the amount of acid (perchloric or hydrochloric) needed to neutralize all or part of a material's basicity, expressed as milligrams of KOH per gram of sample.

The term "lean-phosphorus containing exhaust gas" refers to an exhaust gas that is generated in an internal combustion engine lubricated with a lubricating oil composition containing a zinc salt of a phosphorus containing compound as described herein, the exhaust gas having a relatively low concentration of phosphorus when compared to an exhaust gas generated under the same conditions using the same lubricating oil composition containing the same level of phosphorus except that the phosphorus containing compound is not as described herein.

The Inventive Method

The inventive method provides for lubricating an internal combustion engine while at the same time improving the efficiency of the emissions control system used with the engine. The lubricating oil composition is characterized as a lubricating oil composition that generates a lean-phosphorus containing exhaust gas during operation of the engine. The lean-phosphorus containing exhaust gas is typically advanced to the emissions control system. In the emissions control system the lean-phosphorus containing exhaust gas contacts the catalyst used in the exhaust gas after treatment device. The phosphorus in the lean-phosphorus containing exhaust gas, in general, contaminates the catalyst and thereby reduces its efficiency. However, since the level of phosphorus in the lean-phosphorus containing exhaust gas is at a reduced level, the amount of contamination of the catalyst is reduced. This reduction in contamination results in an improvement in the efficiency of the emissions control system.

The amount of phosphorus in the exhaust gas during the operation of the engine is related to the amount of phosphorus retained in the lubricating oil composition in the crankcase. The amount of phosphorus retained in the crankcase can be calculated from the following formula:

$$\%\ P_{retention} = \frac{(\%\ \text{wt}\ P_{drain})(\%\ \text{wt}\ M_{new})}{(\%\ \text{wt}\ P_{new})(\%\ \text{wt}\ M_{drain})} \times 100$$

wherein: % wt $P_{drain}$ is the percent by weight of phosphorus in the lubricating oil composition in the crankcase at the end of a drain interval; % wt $M_{new}$ is the percent by weight of detergent metal in the lubricating oil composition in the crankcase at the beginning of the drain interval; % wt $P_{new}$ is the percent by weight of phosphorus in the lubricating oil composition in the crankcase at the beginning of the drain interval; and % wt $M_{drain}$ is the percent by weight of detergent metal in the lubricating oil composition at the end of the drain interval. In one embodiment of the invention, the amount of phosphorus retained in the crankcase oil of the engine after a 12000 kilometer (7500 mile) drain cycle is at least about 80% by weight, and in one embodiment at least about 84% by weight, and in one embodiment at least about 88% by weight, and in one embodiment at least about 92% by weight, and in one embodiment at least about 95% by weight, and in one embodiment at least about 98% by weight. In one embodiment of the invention, the amount of phosphorus lost from the crankcase oil with the exhaust gas over a 120,000 km (7500 mile) drain cycle is about 20% by weight or less, and in one embodiment about 16% by weight or less, and in one embodiment about 12% by weight or less, and in one embodiment about 8% by weight or less, and in one embodiment about 5% by weight or less, and in one embodiment about 2% by weight or less.

The Internal Combustion Engine

The internal combustion engine that may be operated in accordance with the invention may be any internal combustion engine that is equipped with an emissions control system that utilizes a catalyst containing exhaust gas after treatment device. These include engines that employ a closed crankcase system and positive crankcase ventilation. The internal combustion engine may be a spark-ignited or a compression-ignited engine. These engines include automobile and truck engines, two-cycle engines, aviation piston engines, marine and railroad diesel engines, and the like. Included are on- and off-highway engines. The compression-ignited engines include those for both mobile and stationary power plants. The compression-ignited engines include those used in urban buses, as well as all classes of trucks. The compression-ignited engines may be of the two-stroke per cycle or four-stroke per cycle type. The compression-ignited engines include heavy duty diesel engines.

The exhaust gas after treatment device may be referred to as a catalytic converter and may be of any conventional design. The exhaust after treatment device may be comprised of flow-through passages of ceramic or metal coated with a washcoat comprised of zeolite, $Al_2O_3$, $SiO_2$, $TiO_2$, $CeO_2$, $ZrO_2$, $V_2O_5$, $La_2O_3$, or mixtures of two or more thereof, the washcoat supporting a catalyst selected from the group consisting of Pt, Pd, Rh, Ir, Ru, V, Cr, Mn, Fe, Co, Ni, Cu, Zn, Ag, Ce, Ga, or a mixture of two or more thereof.

The Lubricating Oil Composition

The lubricating oil composition used in accordance with the inventive method is comprised of one or more base oils which are generally present in a major amount. The base oil may be present in an amount greater than about 60%, and in one embodiment greater than about 70%, and in one embodiment greater than about 80% by weight, and in one embodiment greater than about 85% by weight of the lubricating oil composition. The lubricating oil composition contains: an alkali or alkaline earth metal containing detergent; a metal salt of at least one phosphorus-containing compound represented by formula (I) which typically functions as an antiwear agent, EP additive, corrosion inhibitor and/or antioxidant; and an acylated-nitrogen containing compound which typically functions as a dispersant. The lubricating oil composition may contain other additives known in the art.

The lubricating oil composition may have a viscosity of up to about 16.3 $mm^2/s$ (cSt) at 100° C., and in one embodiment about 5 to about 16.3 $mm^2/s$ (cSt) at 100° C., and in one embodiment about 6 to about 13 $mm^2/s$ (cSt) at 100° C.

The lubricating oil composition may have an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40 or 10W-50. The viscosity grade may be SAE 15W-40, SAE 20, SAE 30, SAE 40 or SAE 20W-50.

The lubricating oil composition may be characterized by a sulfur content of up to about 1% by weight, and in one embodiment up to about 0.5% by weight., e.g., 0.05 to 0.5%.

The lubricating oil composition may be characterized by a phosphorus content of up to about 0.12% or up to about 0.10% or up to about 0.08% or up to about 0.05% by weight, and in one embodiment about 0.03 to about 0. 12% by weight, and in one embodiment about 0.03 to about 0.10% by weight, and in one embodiment about 0.03 to about 0.08% by weight, and in one embodiment about 0.03 to about 0.05% by weight.

The ash content of the lubricating oil composition as determined by the procedures in ASTM D-874-96 may be in the range of about 0.3 to about 1.4% by weight, and in one embodiment about 0.3 to about 1.2% by weight, and in one embodiment about 0.3 to about 1.0% by weight.

The lubricating oil composition may be characterized by a chlorine content of up to about 100 ppm, and in one embodiment up to about 50 ppm, and in one embodiment up to about 10 ppm, e.g., 0.1 or 1 to 10 ppm.

The Base Oil

The base oil used in the lubricating oil composition may be selected from any of the base oils in Groups I-V as specified in the American Petroleum Institute (API) Base Oil Interchangeability Guidelines. The five base oil groups are as follows:

| Base Oil Category | Sulfur (%) | | Saturates(%) | Viscosity Index |
|---|---|---|---|---|
| Group I | >0.03 | and/or | <90 | 80 to 120 |
| Group II | ≦0.03 | and | ≧90 | 80 to 120 |
| Group III | ≦0.03 | and | ≧90 | ≧120 |
| Group IV | All polyalphaolefins (PAOs) | | | |
| Group V | All others not included in Groups I, II, III or IV | | | |

Groups I, II and III are mineral oil base stocks.

The base oil may be a natural oil, synthetic oil or mixture thereof. The natural oils include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils derived from coal or shale are also useful.

Synthetic oils include hydrocarbon oils such as polymerized and interpolymerized olefins, alkylbenzenes, polyphenyls, alkylated diphenyl ethers, alkylated diphenyl sulfides, and derivatives, analogs and homologues thereof. The synthetic oils include alkylene oxide polymers and interpolymers and derivatives thereof where the terminal hydroxyl groups have been modified by esterification, etherification, etc.; esters of dicarboxylic acids (e.g., phthalic acid, succinic acid, alkyl succinic acids, alkenyl succinic acids, etc.) with a variety of alcohols (e.g., butyl alcohol, hexyl alcohol, dodecyl alcohol, 2-ethylhexyl alcohol, ethylene glycol, etc.); and esters made from $C_5$ to $C_{12}$ monocarboxylic acids and polyols or polyol ethers.

In one embodiment, the base oil may be a polyalphaolefin (PAO) or an oil derived from Fischer-Tropsch synthesized hydrocarbons. In other embodiments Group II or group III oils or mixtures thereof can be used, as well as Group III or mixtures of Group III and Group IV oils.

Unrefined, refined and rerefined oils, either natural or synthetic (as well as mixtures of two or more of any of these) of the type disclosed hereinabove can be used as the base oil.

The Mixture of Phosphorus-Containing Zinc Salts

The phosphorus-containing compounds useful in making the phosphorus-containing zinc salt may be a mixture of compounds represented by the formula

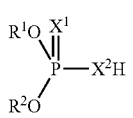

(I)

In this formula (I), $X^1$ and $X^2$ are independently S or O, and in certain embodiments, both $X^1$ and $X^2$ are sulfur. Such materials are known as zinc dialkyldithiophosphates, "ZDPs," or zinc dihydrocarbyldithiophosphates, depending on the nature of the R groups.

$R^1$ and $R^2$ are independently hydrocarbyl groups, and may be alkyl groups, and the selection of the particular hydrocarbyl groups is important in providing compounds suitable for reduced phosphorus contamination of the exhaust gas after-treatment device when used in an engine lubricant. In particular, the average total number of carbon atoms in $R^1$ plus $R^2$ for the mixture of phosphorus-containing compounds should be at least 9.5, e.g., 9.5 to 17 or 9.5 to 16.5 or alternatively 10.4 to 16, or 10.8 to 15.5, or 11.0 to 15.0.

Moreover, $R^1$ and $R^2$ are characterized in that (i) 4 to 30 or 4.5 to 30 or 5 to 30 weight percent of such groups contain 2 to 4 carbon atoms and (ii) 70 to 95 or to 95.5 or to 96 weight percent such groups contain 5 to 12 carbon atoms. In other embodiments (i) 10 to 25 weight percent such groups contain 2 to 4 carbon atoms and (i) 75 to 90 percent contain 5 to 12 carbon atoms. Alternatively (i) 5 to 30 (or 10 to 25) weight percent of such groups contain 2 to 4, or 3, carbon atoms and (ii) 70 to 95 (or 75 to 90) weight percent of such groups contain 6 to 10 carbon atoms. (These weight percent calculations are based on the $R^1$ and $R^2$ groups themselves, and not on the weight of the alcohols from which they are derived, which would give slightly different numbers, as would be apparent to the person skilled in the art.)

The R groups containing 2, 3, or 4 carbon atoms may be derived from reaction of alcohols such as ethanol, n-propanol, isopropanol, n-butanol, sec-butanol, or t-butanol. The R groups containing 5 to 12 carbon atoms may be derived from reaction of any of a large number alcohols containing 5 to 12 carbon atoms, provided, of course, that other requirements for the R groups as set forth herein are met. Examples of alcohols with 5 to 12 carbon atoms include pentanol, hexanol, heptanol, octanol, nonanol, decanol, undecanol, dodecanol, including both linear, branched, and cyclic isomers such as 2-hexanol, 4-methyl-2-pentanol, cyclohexanol, 2-ethylhexanol, and 2,6-dimethylheptan-4-ol ("diisobutylcarbinol"). In one embodiment the $R^1$ and $R^2$ groups are derived from a mixture comprising isopropanol and at least one of 4-methyl-2-pentanol and 2,6-dimethylheptan-4-ol.

Additionally, the groups $R^1$ and $R^2$ are selected such that the average total number of hydrogen atoms located on carbon atoms beta to the O atom in the groups $R^1$ and $R^2$ in formula (I) is at least 7.25 or, alternatively, is 9 to 12. It will be understood that the beta position or positions in the R group is defined as the carbon atoms immediately adjacent to the carbon atom which is attached to the oxygen atom. Thus, for example, an isopropyl group has 6 hydrogen atoms on carbon atoms in the β position, an n-hexyl group has 2 hydrogen atoms on the single carbon atom in the β position, and secondary hexyl groups may have as many as 5 hydrogen atoms on carbon atoms in the β position, depending on the particular isomer considered.

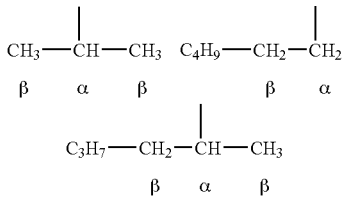

As an illustration, if both $R^1$ and $R^2$ are isopropyl in a given molecule, there will be, for that molecule, a total of 12 such β hydrogens. If $R^1$ is isopropyl and $R^2$ is n-hexyl, there will be 8 such β hydrogens for that molecule. The average value is that for all the molecules of formula (I) in the mixture.

As related to this requirement, in certain embodiments the percentage of the R groups which are secondary groups may be at least 90 mole percent or at least 95 percent or at least 97 percent.

While not intending to be bound by any theory, it is believed that having on average at least 7.25 hydrogens on the β carbon position in the group $R^1$ and $R^2$ in the compound (or mixture of compounds) of Formula (I) is desirable in order to facilitate a pathway for reaction of the molecules by β-elimination. This, in turn, is thought to generate one or more P-containing species which may interact with metal surfaces in an engine and thereby reduce wear.

Given only the requirements thus far enumerated, R groups with the required properties could be obtained simply by an appropriate selection of alcohols to prepare individual ZDPs, and then blending the individual ZDPs in appropriate ratios. The conventional synthesis of ZDPs is well known. It typically involves the reaction of phosphorus pentasulfide ($P_2S_5$) and an alcohol or phenol to form an O,O-dihydrocarbyl phosphorodithioic acid corresponding to that of formula (I) above. The reaction conventionally involves mixing at a temperature of 20° C. to 200° C., four moles of an alcohol or a phenol with one mole of phosphorus pentasulfide. Hydrogen sulfide is liberated in this reaction. The acid is then reacted with a basic zinc compound such as zinc oxide, to form the salt. The R groups, which are derived from the alcohols, may be free from acetylenic and usually also from ethylenic unsaturation.

However, the materials used in the present invention have an additional requirement which is not readily satisfied by the conventional synthesis route. In particular, for the materials of the present invention, in less than 8 mole percent (or less than 6 or less than 4 percent, e.g, 0.5 to 3% or 1 to 5%) of the molecules of formula (I) in the mixture of phosphorus-containing compounds, each of $R^1$ and $R^2$ contain 2 to 4 carbon atoms, and in greater than 11 (or 15 or 18) mole percent of the molecules of formula (I) in said mixture $R^1$ has 2 to 4 carbon atoms and $R^2$ has 5 to 12 carbon atoms. That is to say, in only a small percentage of the molecules are both of the R groups short chain groups of 2 to 4 carbon atoms. Moreover, in a relatively larger percentage of the molecules, at least one of the R groups is a longer chain group, while one of them is a short (e.g., C3) group.

It has been customary practice to prepared mixed ZDPs, that is, having alkyl groups of certain, mixed chain lengths, by preparing and then mixing appropriate amounts of ZDPs containing selected alkyl groups. For example, a mixed ZDP having 50 mole percent C3 groups and 50 mole percent C6 groups could be readily prepared by mixing 0.5 moles of ZDP prepared from isopropanol and 0.5 moles of ZDP prepared from a hexanol. More to the point of the present invention, a mixture of ZDPs containing about 14 mole percent C3 groups and about 86 mole percent C6 groups customarily would have been made by mixing two commercially available materials of Formula (I): 77 mole percent of (P) a material containing 100% C6 alkyl groups, and 23 mole percent of (Q) a material prepared with 60 mole % C3 groups and 40 mole % C6 groups. Either the two materials (P) and (Q) of Formula (I) would be mixed and the mixture reacted with ZnO to form the ZDP, or else two ZDPs, prepared separately from materials (P) and (Q) would be mixed. However, in any such mixture, the distribution of R groups will reflect the distribution of R groups in the constituent molecules of Formula (I). Thus, within (Q), on a statistical basis about 36 mole percent of the molecules will contain two C3 groups. Accordingly, in the mixture of the two ZDPs derived from (P)+(Q), about 8.3 mole percent of the molecules represented by formula (I) will contain two C3 groups.

However, in the present invention it is required, in order to provide reduced phosphorus volatility, that less than 8 mole percent of the molecules of Formula (I) will contain two such short chain R groups, and in other embodiments less than 6 or less than 4 percent. It has now been discovered that this property is important to reduced phosphorus volatility, and it can be met by preparing the ZDPs by a mixed-alcohol route. In particular, the ZDPs are prepared by first mixing the required mixture of alcohols with carbon numbers as defined herein in a proportion required to obtain the desired or specified mixture of $R^1$ and $R^2$ groups, and reacting the mixture of alcohols with a phosphorus source such as $P_2S_5$, forming a mixture of molecules of Formula (I) which are subsequently salted with Zn. By employing such a process to the example given in the previous paragraph, rather than obtaining 8.3 mole percent of molecules with two C3 groups, one will obtain a mixture in which only 2 mole percent of the molecules of Formula (I) will have two C3 groups. Similarly, within the mixture about 74 mole percent of the molecules of Formula (I) will contain two C6 groups and about 24 mole percent will contain one C3 and one C6 group. Thus the amount of the C3-C3 and the C6-C6 materials will be reduced, and the amount of the C3-C6 material will be increased.

Thus the method of the present invention may well prepare a ZDP with mixed alcohols having the same overall or gross composition as in customary materials. But the particular materials prepared have a more effective and advantageous distribution of lower and higher molecular weight alkyl groups within the individual molecules, so as to provide a superior balance of wear performance and phosphorus volatility than has been previously known. One may also characterize such a distribution by noting that, in certain embodiments, the mole percentage of structures of Formula I having two R groups of 2 to 4 carbon atoms is less than 8, or less than 6 or 4 or even less than 3, and the mole percentage having mixed R groups, that is one of 2 to 4 (e.g., 3) carbon atoms and one of 5 to 12 (e.g., 6) carbon atoms, is greater than 11 or greater than 15 or than 18 or even greater than 20.

It is also known that basic variations of ZDP may be formed during the zinc oxide reaction, for example, from the reaction of 3 moles of neutral zinc dithiophosphate and one mole of zinc oxide. Thus, varying amounts of the basic zinc salt may be formed depending on the amount, if any, of equivalent excess of zinc oxide is present. In certain embodiments, 5 to 40 percent, or 10 to 30 percent, or 15 to 25 percent of such basic zinc salt may be present in the ZDP. It is also possible to prepare the ZDP by employing varying amounts of a carboxylic acid to aid in formation of the zinc salt, and certain amounts of the carboxylic acid may be incorporated in the ZDP mixture. For example, any of the C2 through C18 or C12 carboxylic acids such as acetic acid, hexanoic acids, or octanoic acids such as 2-ethylhexanoic acid may be used. The amounts of the carboxylic acid, if present may typically be 0.01 (or less) to 0.5 equivalents per equivalent of zinc oxide, or 0.02 to 0.3, or 0.1 to 0.25 equivalents per equivalent of zinc. The variations described in this paragraph, separately or together, are intended to be encompassed within the scope of the claims of the present invention.

The phosphorus-containing zinc salts may be employed in the lubricating oil composition at a concentration sufficient to provide the lubricating oil composition with a phosphorus concentration in the range of up to about 0.12% by weight, and in one embodiment 0.02 or 0.03 to 0.12% percent by weight, and in one embodiment 0.03% to 0.10% by weight, and in one embodiment 0.03 to 0.08% by weight, and in one embodiment 0.03 to 0.05% by weight. The amount of the phosphorus-containing zinc salts may typically be 0.2 to 1.2 weight percent or 0.5 to 1.0 weight percent, or such other amounts as will be apparent to the person skilled in the art.

Additional Lubricating Oil Additives

The lubricating oil composition may also contain other lubricant additives known in the art. These include, for example, corrosion-inhibiting agents, antioxidants, viscosity modifiers, dispersant viscosity index modifiers, pour point depressants, friction modifiers, antiwear agents other than those discussed above, EP agents other than those discussed above, dispersants other than those discussed above, detergents other than those discussed above, fluidity modifiers, copper passivators, anti-foam agents, etc. Each of the foregoing additives, when used, is used at a functionally effective amount to impart the desired properties to the lubricant. Generally, the concentration of each of these additives, when used, ranges from 0.001% to 20% by weight, and in one embodiment 0.01% to 10% by weight based on the total weight of the lubricating oil composition.

Concentrates and Diluents

The foregoing lubricating oil additives can be added directly to the base oil to form the lubricating oil composition. In one embodiment, however, one or more of the additives are diluted with a substantially inert, normally liquid organic diluent such as mineral oil, synthetic oil, naphtha, alkylated (e.g., $C_{10}$-$C_{13}$ alkyl) benzene, toluene or xylene to form an additive concentrate. These concentrates usually contain1% to 99% by weight, and in one embodiment 10% to 90% by weight of such diluent. The concentrates may be added to the base oil to form the lubricating oil composition.

EXAMPLES

Several compositions of ZDPs with mixed R groups are prepared by reacting and mixing at a temperature of 80° C, a mixture of alcohols as set forth below, with phosphorus pentasulfide. The resulting mixed acid is then reacted with zinc oxide in the amounts indicated, to form the mixed zinc salts.

Preparation 1. A mixture of 12 mole percent isopropanol and 88 mole percent 4-methyl-2-pentanol is reacted with phosphorus pentasulfide in approximately a 4.5:1 molar ratio at a maximum temperature of 80° C. The resulting dithiophosphoric acid mixture is reacted with a 12% molar excess of zinc oxide suspended in mineral oil at a temperature of 90° C. for four hours. After the reaction is complete, water of reaction and excess alcohols are distilled under a reduced pressure of 2.7 kPa (20 mm Hg) at 90° C. The product, containing about 9 percent by weight diluent oil, has a Total Base Number (TBN, ASTM D-2896) of 5.56 and includes about 14 percent basic zinc dithiophosphate by $^{31}$p NMR analysis. The product contains 8.70% P and 9.45% Zn. (The basic zinc salt is a known material which is formed during the zinc oxide reaction, from 3 moles of neutral zinc dithiophosphate and one mole of zinc oxide. The basic zinc salt is believed to be in the form of a tetrahedral complex that titrates with strong mineral acid, and it is believed to account for the TBN content of the product mixture.)

Preparation 2. Preparation 1 is substantially repeated except that the amount of zinc oxide is employed such that the TBN of the product is 5.5 and the % basic salt is about 14 mole percent by $^{31}$p NMR analysis. The product contains 8.7% P and 9.45% Zn.

Preparation 2a. Preparation 1 is substantially repeated, except that additional zinc oxide is employed such that the TBN of the product is 8.03, and the percent basic salt is about 18 mole percent by 31P NMR analysis. The product contains 8.56% P and 9.45% Zn.

Preparation 3. Preparation 1 is substantially repeated except that acetic acid promoter is used and the amount of zinc oxide employed provides a product with a TBN of 16.8, and the percent basic salt is about 29 mole percent. The amount of acetic acid promoter is 4 weight percent of the zinc oxide charged. The product contains 8.25% P and 9.64% Zn.

Preparation 4. 659 g (1.97 equivalents) of the dithiophosphoric acid mixture of Preparation 1 and 80 g (0.555 equivalents) of 2-ethylhexanoic acid promoter are reacted with 111.5 g (2.75 equivalents) of zinc oxide to provide a product having a TBN of 51.5 and about 21 mole percent basic ZDP salt. The product contains 7.47% P and 10.76% Zn Preparation 5 (comparative). This material is a commercially available ZDP prepared using 60 mole % isopropanol and 40 mole % 4-methyl-2-pentanol as the constituent alcohols (the material containing about 8-9% diluent oil). The product contains 10.0% P and 11.05% Zn.

Preparation 6 (comparative). A mixture of ZDPs is prepared having the same overall mixture of alcohol-derived R groups as in Preparation 1. However, this mixture is prepared by mixing 79-80 mole weight percent of a conventional ZDP (containing 8-9% diluent oil) prepared using 4-methyl-2-pentanol as the constituent alcohol and 19-20 weight percent of the conventional ZDP of Preparation 5. The mixture contains 8.5% P and 9.67% Zn.

Preparation 7. Preparation 1 is substantially repeated except that the 88 mole percent 4-methyl-2-pentanol is replaced by 88 mole percent diisobutylcarbinol. The product contains 7.04 weight percent P and 7.22 weight percent Zn, has a TBN of 0.66, and includes about 8 percent basic zinc dithiophosphate.

Formulations 1, 2, 3, and 4. Certain of the above preparations (including their small amounts of diluent oil) are used in preparing lubricant formulations typical of heavy duty diesel lubricants. Each formulation contains identical or nearly identical amounts of mineral oil, olefin copolymer viscosity modifiers, polymeric pour point depressants, antioxidants, corrosion inhibitor, succinimide dispersant and alkyl succinic anhydride, overbased calcium sulfonate detergents, and anti-foam agent. The formulations are subjected to the Selby-Noack™ Phosphorus Emissions Index test (ASTM D5800, modified), which involves subjecting a small amount (<10 g) of a fresh oil sample to air at 250 ° C. for 1 hour and collecting the volatile components. The amount of phosphorus is measured by ASTM D4951. The results in terms of P volatility and the phosphorus emission index (PEI) are shown in the following Table 1:

TABLE 1

| Formulation | Preparation, amount | ppm P in fresh oil | ppm P in volatiles | PEI (mg volatile P/L oil) |
|---|---|---|---|---|
| 1 | 2, 1.48% | 1146 | 142 | 14 |
| 2 | 4, 1.48% | 988 | 82 | 8 |
| 3 (comparative) | 5 (comp.), 1.15% | 1034 | 276 | 25 |
| 4 | 7, 1.42% | 929 | 37 | 3 |

The ZDPs of the present invention exhibit reduced phosphorus volatility, compared with a conventional ZDP.

Formulations 5, 6, and 7. Formulations are prepared in an engine lubricant containing mineral oil, viscosity index improvers, succinimide dispersant(s), antioxidants, friction modifiers, overbased calcium sulfonate detergents, and anti-foam agent. Formulation 5 contains 1.03 percent of the ZDP mixture of Preparation 4, Formulation 6 (comparative) contains 0.82 percent of the ZDP mixture of Preparation 6 (comparative), and Formulation 7 contains 1.21 percent of the ZDP mixture of Preparation 7. Otherwise, the formulations are substantially identical. (Formulation 6 contains about 0.3% more of a slightly different succinimide dispersant than does Formulation 5, and the amount of the additive package in Formulation 7 excluding the oil, VI improvers, and ZDP component is increased by a factor of about 1.14.)

Formulations 5, 6, and 7 are subjected to a Falex Block on Ring wear test. Tests are run at 125° C., speed 1000 r.p.m., 445 N load (45.4 kg, 100 lb.), oil sample 60 mL, test length 60 minutes. Test blocks are made from super proferal gray cast iron. The test surfaces are evaluated by XPS (x-ray photoelectron spectroscopy), which provides an analysis of elemental phosphorus in surface film on and immediately beneath the surface of the steel test sample. Higher levels of phosphorus at and below the surface layer indicate more effectively imparting of antiwear properties. The results are shown in Table 2, below, given in terms of percent P observed at the surface or at the indicated depth (nm) below the surface.

TABLE 2

| Formulation | Preparation | Surface | 5 nm | 70 nm |
|---|---|---|---|---|
| 5 | 4 | 6.7 | 9.6 | 3.3 |
| 6 (comp) | 6 (comp) | 5.9 | 7.4 | 0[a] |
| 7 | 7 | 3.4 | 5.5 | 3.1 |

[a]less than 0.1%

The results indicate that the ZDP mixtures of the present invention may impart more protective phosphorus to a steel surface than do comparative mixtures, particularly at depths below the immediate surface.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method of lubricating an internal combustion engine equipped with a catalyst-containing exhaust-gas aftertreatment device, the method comprising supplying to said engine a lubricating oil composition comprising:

(a) a base oil; and (b) a zinc salt of a mixture of phosphorus-containing compounds represented by the formula

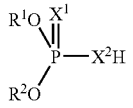

(I)

wherein in formula (I), $X^1$ and $X^2$ are independently S or O, and $R^1$ and $R^2$ are independently hydrocarbyl groups, the average total number of carbon atoms in $R^1$ plus $R^2$ for the mixture of phosphorus-containing compounds being at least about 9.5;

wherein $R^1$ and $R^2$ are characterized in that (i) about 4 to about 30 weight percent of such groups contain 2 to 4 carbon atoms and (ii) about 70 to about 96 weight percent such groups contain 5 to 12 carbon atoms; and wherein, in less than 8 mole percent of the molecules of formula (I) in the mixture of phosphorus-containing compounds, each of $R^1$ and $R^2$ contain 2 to 4 carbon atoms and in greater than 11 mole percent of the molecules of formula (I) in said mixture $R^1$ has 2 to 4 carbon atoms and $R^2$ has 5 to 12 carbon atoms;

and wherein, within formula (I), the average total number of hydrogen atoms in $R^1$ and $R^2$ on carbon atoms located beta to the O atoms is at least 7.25;

the lubricating oil composition being characterized by a phosphorus concentration of up to about 0.12 percent by weight.

2. The method of claim 1 wherein $X^1$ and $X^2$ are both sulfur.

3. The method of claim 1 wherein 10 to 25 mole percent of the groups $R^1$ and $R^2$ contain 2 to 4 carbon atoms and about 75 to about 90 mole percent of such groups contain 5 to 12 carbon atoms.

4. The method of claim 1 wherein $R^1$ and $R^2$ are characterized in that (i) about 5 to about 30 weight percent of such groups contain 3 carbon atoms and (ii) about 70 to about 95 weight percent of such groups contain 6 to 10 carbon atoms.

5. The method of claim 1 wherein, in less than 5 mole percent of the molecules in the mixture of phosphorus-containing compounds, each of $R^1$ and $R^2$ contains 2 to 4 carbon atoms.

6. The method of claim 1 wherein, in less than 2 mole percent of the molecules in the mixture of phosphorus-containing compounds, each of $R^1$ and $R^2$ contains 2 to 4 carbon atoms.

7. The method of claim 1 wherein the average total number of carbon atoms in $R^1$ and $R^2$ is about 9.5 to about 16.5.

8. The method of claim 1 wherein the average total number of carbon atoms in $R^1$ and $R^2$ is about 10.8 to about 15.5.

9. The method of claim 1 wherein the average total number of carbon atoms in $R^1$ and $R^2$ is about 11.0 to about 15.

10. The method of claim 1 wherein at least about 90 percent of the $R^1$ and $R^2$ groups are derived from secondary alcohols.

11. The method of claim 1 wherein at least about 95 percent of the $R^1$ and $R^2$ groups are derived from secondary alcohols.

12. The method of claim 1 wherein at least about 99 percent of the $R^1$ and $R^2$ groups are derived from secondary alcohols.

13. The method of claim 1 wherein the $R^1$ and $R^2$ groups are derived from a mixture comprising isopropanol and at least one of 4-methyl-2-pentanol and 2,6-dimethylheptan-4-ol.

14. The method of claim 1 wherein the lubricating oil composition is characterized by a phosphorus concentration of up to about 0.08 percent by weight.

15. The method of claim 1 wherein the lubricating oil composition is characterized by a phosphorus concentration of up to about 0.05 percent by weight.

16. The method of claim 1 wherein the amount of the metal salt of a mixture of phosphorus-containing compounds in the lubricating composition is about 0.2 to about 1.2 weight percent.

17. The method of claim 1 wherein the mixture of phosphorus-containing compounds is prepared by reacting $P_2X_5$, where each X is independently S or O, with a mixture of alcohols with carbon numbers as set forth in (i) and (ii) in a proportion required to obtain the specified mixture of $R^1$ and $R^2$ groups.

18. The method of claim 1 wherein the lubricating composition further comprises an alkali or alkaline earth metal-containing detergent.

19. The method of claim 1 wherein the lubricating composition further comprises an acylated nitrogen-containing dispersant.

20. The method of claim 1 further comprising operating the engine, generating a phosphorus-lean exhaust gas, and contacting the catalyst in the exhaust gas after treatment device with the phosphorus-lean exhaust gas.

21. A lubricating oil composition comprising:

(a) a base oil; and (b) a zinc salt of a mixture of phosphorus-containing compounds represented by the formula (I)

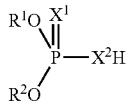

wherein in formula (I), $X^1$ and $X^2$ are independently S or O, and $R^1$ and $R^2$ are independently hydrocarbyl groups, the average total number of carbon atoms in $R^1$ plus $R^2$ for the mixture of phosphorus-containing compounds being at least about 9.5;

wherein $R^1$ and $R^2$ are characterized in that (i) about 4 to about 30 weight percent of such groups contain 2 to 4 carbon atoms and (ii) about 70 to about 96 weight percent such groups contain 5 to 12 carbon atoms; and wherein, in less than 8 mole percent of the molecules of formula (I) in the mixture of phosphorus-containing compounds, each of $R^1$ and $R^2$ contain 2 to 4 carbon atoms and in greater than 11 mole percent of the molecules of formula (I) in said mixture $R^1$ has 2 to 4 carbon atoms and $R^2$ has 5 to 12 carbon atoms;

and wherein, within formula (I), the average total number of hydrogen atoms in $R^1$ and $R^2$ on carbon atoms located beta to the O atoms is at least 7.25;

the lubricating oil composition being characterized by a phosphorus concentration of up to about 0.12 percent by weight.

22. The method of claim 1 wherein, in greater than 14 mole percent of the molecules of formula (I) in said mixture, $R^1$ has 2 to 4 carbon atoms and $R^2$ has 5 to 12 carbon atoms.

* * * * *